US006065384A

United States Patent [19]

Widder et al.

[11] Patent Number: 6,065,384

[45] Date of Patent: May 23, 2000

[54] VARIABLE VELOCITY WEAPON SYSTEM HAVING SELECTIVE LETHALITY AND METHODS RELATED THERETO

[75] Inventors: Jeffrey Michael Widder; Roger Allen Sherman, both of Bel Air, Md.; Steven Vance Medlin, Laguna Niguel, Calif.

[73] Assignee: Widlin Corporation, Towson, Md.

[21] Appl. No.: 08/966,897

[22] Filed: Nov. 10, 1997

[51] Int. Cl.[7] ..... F41A 21/00; F41A 5/00; F42B 14/00

[52] U.S. Cl. ..... 89/14.05; 89/14.2; 89/14.6; 89/193; 102/520

[58] Field of Search ..... 102/520, 521, 102/522, 523; 89/14.05, 14.2, 14.3, 14.4, 14.5, 14.6, 191.01, 191.02, 193

[56] References Cited

U.S. PATENT DOCUMENTS

| | | | |
|---|---|---|---|
| 1,628,896 | 5/1927 | Medearis | 89/14.05 |
| 2,442,382 | 6/1948 | Sieg | 89/14.3 |
| 2,503,491 | 4/1950 | Janz | 89/14.4 |
| 3,435,768 | 4/1969 | Engel | 102/523 |
| 3,695,181 | 10/1972 | Bull et al. | 102/522 |
| 3,769,912 | 11/1973 | Friend | 102/522 |
| 4,765,224 | 8/1988 | Morris | 89/191.01 |
| 4,800,816 | 1/1989 | Meyer | 102/523 |
| 4,928,573 | 5/1990 | Fansler et al. | 89/14.4 |
| 5,014,624 | 5/1991 | Baxter et al. | 102/520 |
| 5,182,419 | 1/1993 | Burnette | 102/523 |
| 5,272,956 | 12/1993 | Hudson | 89/193 |
| 5,463,930 | 11/1995 | Bisping et al. | 89/14.5 |

*Primary Examiner*—Charles T. Jordan
*Assistant Examiner*—Theresa M. Wesson
*Attorney, Agent, or Firm*—Brian D. Voyce

[57] ABSTRACT

The present invention relates to weapon systems that accelerate projectiles using gases generated by the rapid combustion of a solid propellant, in particular, such a weapon system is able to vary the barrel exiting velocity of the projectile through a barrel venting means. In one embodiment, a front venting means exhausts gas generated by combusting propellant from behind the accelerating projectile and redirects a portion of the exhausted gas either to at least one fixed volume, to the front of the projectile, or to a combination of at least one fixed volume and to the front of the projectile. Redirecting some of the exhausted gas to the front of the projectile restrains the projectile, thereby slowing the projectile, and thus further decreasing the muzzle velocity of the projectile. In another embodiment, gas from behind the projectile is exhausted into a fixed volume, thereby decreasing projectile acceleration, and thus, the muzzle velocity of the projectile. One can use a combination of fixed volume venting and front venting. A saboted projectile can be used for ammunition. By coupling the energy requirements needed to release the sabot to the barrel exiting velocity of the projectile, one can achieve a selectively lethal projectile. The venting means can be variable as to the velocity and mass of propellant gases exhausted or redirected and can be coupled to an operator selection switch, as well as to an automatic range finding scope.

59 Claims, 14 Drawing Sheets

VARIABLE VELOCITY WEAPON SYSTEM HAVING SELECTIVE LETHALITY AND METHODS RELATED THERETO

TECHNICAL FIELD

The present invention relates to weapon systems that accelerate projectiles using gases generated by the rapid combustion of a solid propellant, in particular, such a weapon system is able to vary the barrel exiting velocity of the projectile through a barrel venting means. In one embodiment, a front venting means exhausts gas generated by combusting propellant from behind the accelerating projectile and redirects a portion of the exhausted gas either to at least one fixed volume, to the front of the projectile, or to a combination of at least one fixed volume and to the front of the projectile. Redirecting some of the exhausted gas to the front of the projectile restrains the projectile, thereby slowing the projectile, and thus further decreasing the muzzle velocity of the projectile. In another embodiment, gas from behind the projectile is exhausted into a fixed volume, thereby decreasing projectile acceleration, and thus, the muzzle velocity of the projectile. One can use a combination of fixed volume venting and front venting. A saboted projectile can be used for ammunition. By coupling the energy requirements needed to release the sabot to the barrel exiting velocity of the projectile, one can achieve a selectively lethal projectile. The venting means can be variable as to the velocity and mass of propellant gases exhausted or redirected and can be coupled to an operator selection switch, as well as to an automatic range finding scope.

DISCLOSURE OF THE INVENTION

The present invention relates to weapon systems that accelerate projectiles using gases generated by the rapid combustion of a solid propellant, in particular, such a weapon system is able to vary the muzzle velocity of the projectile through a barrel venting means. A venting means exhausts gas from behind the accelerating projectile either to at least one fixed volume, to the front of the projectile, or to a combination of at least one fixed volume and to the front of the projectile. Exhausting gas from behind the projectile decreases projectile acceleration, and thus, the barrel exiting velocity. Redirecting some of the exhausted gas to the front of the projectile restrains the projectile, thereby slowing the projectile, and thus, further decreasing the muzzle velocity of the projectile.

A cartridge having a saboted projectile can be used for ammunition. The sabot can be designed either to discard or to remain attached to a core penetrator. In the case of a discarding sabot, by coupling the energy requirements needed to release the sabot from a core penetrator to the muzzle velocity of the projectile, one can achieve a selective lethal projectile. In the case of a non-discarding design, the sabot has a low mass with respect to the core penetrator and is comprised of a material having sufficient strength to remain attached to the penetrator even at the maximum muzzle velocity. The selectable lethality of the non-discarding sabot ammunition comes solely from the lowering of the muzzle velocity. The venting means can be variable as to the velocity and mass of propellant gases exhausted or redirected and can be coupled to an operator selection switch as well as to an automatic range finding scope.

An important objective of the present invention is to lower the muzzle velocity of a projectile while maintaining a clean bum of propellant. The rate of combustion for a given propellant and the efficiency of combustion are directly proportional to the pressure during combustion. Ordinarily, the lowering of the muzzle velocity by lowering the pressure of combusting propellant to the atmosphere causes an incomplete combustion. As a result, unburned propellant is left in the barrel or the venting means. Unburned propellant can be a dangerous nuisance for a number of reasons. It can fall into the ammunition chamber, and either prevent the next round from chambering, or cause the brass casing of the next round to get stuck and not extract after firing. It can interfere with the venting means, causing an uneven venting and thus affecting the muzzle velocity and hence the lethality of a projectile.

The present invention avoids these inconsistent and incomplete combustion problems by venting the burning propellant gasses to either at least one fixed volume, to the front of the projectile, or to a combination of at least one fixed volume and to the front of the projectile. By doing this, the pressure of the vented gas, which may contained pyrolysis products and unburned propellant, is maintained above that of gas vented to the atmosphere. This allows the unburned propellant and the pyrolysis products that are vented to continue combusting, even while the muzzle velocity of the projectile is reduced. One can size the fixed volumes either to obtain complete combustion or to reach a preferred level of consistently burned propellant, albeit maybe not completely burned. By having complete combustion even at reduced muzzle velocities, one can achieve consistent interior ballistics, and thus, consistent accuracy and lethality at each of the selected muzzle velocities.

For the purposes of the present invention, the distinction between a lethally selected shot and a non-lethal selected shot can be estimated in light of the following guidelines. Non-penetration of a projectile into a target does not determine lethality, but is desired for non-lethal shots. The United States Army, has set about 50 to 58 foot pounds (fp) of kinetic energy (KE) as the maximum allowable energy to produce a non-lethal impact, (assuming a non-penetrating impact that also does not hit a sensitive part of the body like the eye, throat, liver, or kidney). The Israeli Army has determined empirically, from 10 years of shooting rubber bullets during the Intefada, that a rounded or flat projectile impacting with 38 Joules/$cm^2$ or less will be non-penetrating, but may cause splitting of the skin and flesh and large bruises. For example, using a 0.50 caliber projectile, the line between lethal and non-lethal can be estimated to be about 48 Joules or 36 fp of kinetic energy (KE). Thus, for the following weight 0.50 cal projectiles—(100, 110, 120, 130, 140 and 150 grains) the maximum terminal (not muzzle) velocities the projectiles can have and still be considered non-penetrating with 36 fp of KE are, respectively, 401, 383, 366, 352, 339, and 328 fps. Other relationships for differing mass and size projectiles can be determined by one of ordinary skill in the art using these guidelines.

BEST MODE FOR CARRYING OUT THE INVENTION

Figure 1:
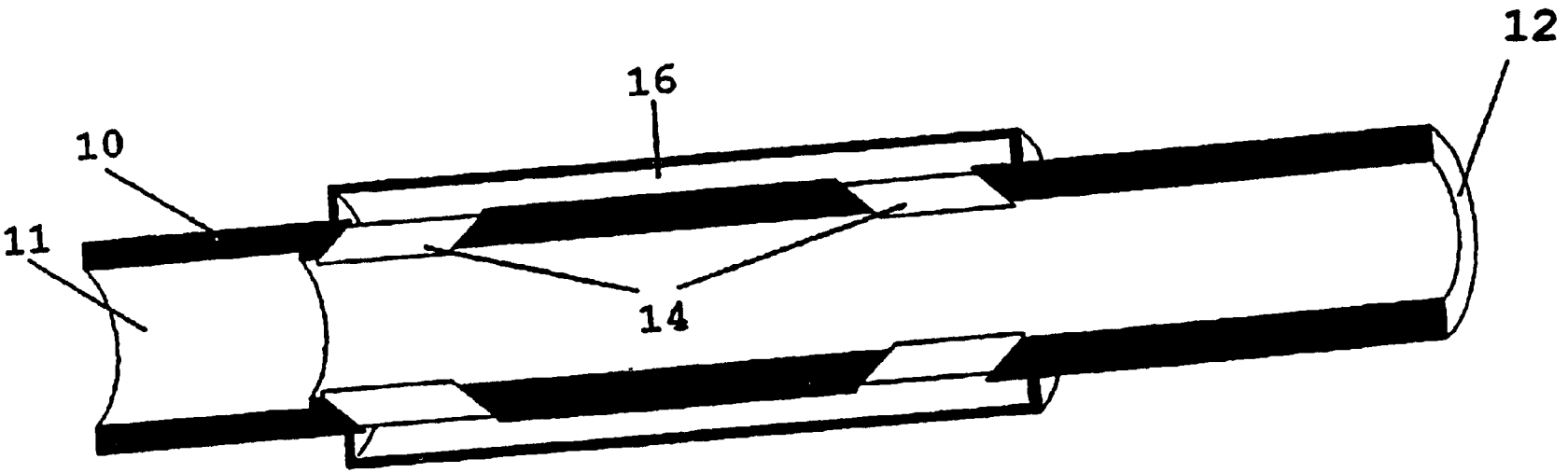
FIG. 1 is a sectional view of a barrel incorporating the present invention using front venting.

A small arms, gas loading rifle, such as an M-16A2, can be converted by replacing the upper receiver which contains the conventional barrel, bolt, and gas handling system with a new upper receiver incorporating the present invention. In one embodiment of the present invention, seen in FIG. 1, the new barrel (10), having a breech end (11) and a muzzle end (12), comprises a series of vents (14) disposed along the length of the barrel. The vents can communicate with a gas vent channel (16) and at least one fixed volume (18). Typically, the fixed volume is vented from the breech end of the barrel, and the fixed volume does not directly communicate with the gas vent channel.

The burning of propellant is a dynamic process. As the combustion starts, the gas vent channel is pressurized from the expanding gas after the base of the projectile has passed the vent location in the barrel. The gas vent channel volume will be filled and pressurized while the channel, through the vents, redirects exhausted gas to the front of the projectile. Simultaneously, if a vent that angles rearward is opened to a fixed volume, the gas will also rush into the fixed volumes, pressurizing them as well. As the projectile clears the muzzle, pressurized gas from the fixed volumes will then rush into the barrel at the breech end, creating a flow towards muzzle end of the barrel that will flush any unburnt propellant out of the barrel before it can fall into the chamber region, thereby causing a feeding or extraction jam. By angling the vents to the fixed volume rearward the flow of gas back into the barrel will act to cause an aspirated flow when the breach opens creating an additional flushing action. By controlling the extent of communication, the exiting velocity of the projectile is reduced in a controlled manner, and thus, the lethality of the projectile is controlled.

A preferred means of venting to the gas vent channel directs the gasses from behind the projectile towards the front of the projectile. Not only is propellant force being removed from accelerating the projectile as it travels down the barrel, but that force is then applied as a restraining force to further slow the projectile. Not only is the pressure differential that accelerates the projectile decreased, but also the mass of gas that the projectile must expel from the barrel is increased. Normally available small arms propellants, such as those made principally from nitrocellulose and nitroglycerin, can work in the present invention because the propellant gasses are produced at such a high temperature that the maximum velocity that the gas can travel ranges from twenty to two times that of the instantaneous projectile velocity during the initial few inches of projectile travel for the non-vented case.

Barrel Design

Various configurations can be incorporated as a barrel venting means suitable for the present invention. One can use front venting, (where vents are placed to be in front of a projectile such that expanding propellant gasses are directed to the front of the projectile so as to slow it down), fixed volume venting, (where one vents the propellant gasses into a fixed volume which is sized to provide a desired degree of velocity retardation), or a combination of the two.

Figure 2:
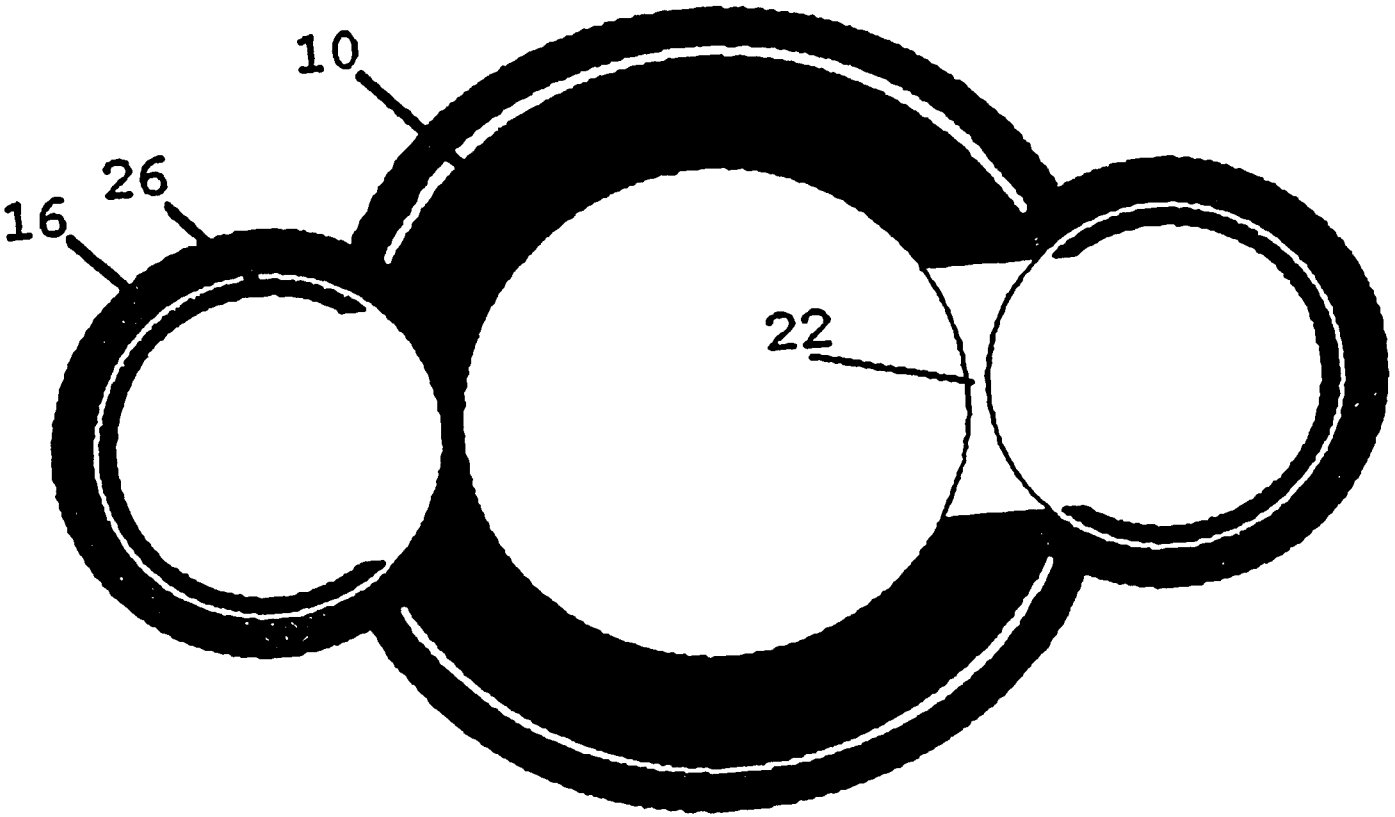
FIG. 2 is a bore sectional view of one embodiment of the venting means using paired vents.
Figure 3:
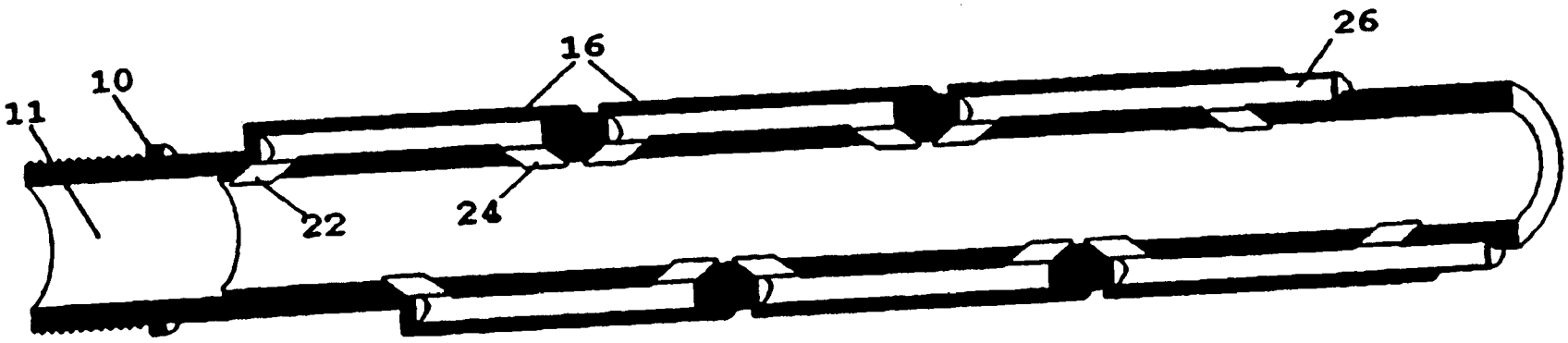
FIG. 3 is a detailed sectional view of one embodiment of the venting means using paired vents.

Two alternative front venting means can be used in the present invention for directing the gas to the front of the projectile. A first embodiment, referred to as a paired vent design, comprises at least one parallel row of openings equally spaced around the circumference of the barrel and disposed along the length of the barrel, as shown in FIG. 1. As seen in the bore sectional view of FIG. 2, the openings are preferably disposed in a plane that cuts through the diameter of the barrel, however, this is not mandatory. From a longitudinal perspective, FIG. 3 shows a preferred placement of the vents wherein the openings on one side of the barrel are placed about halfway between the openings on the opposing row. In each row, the openings are paired. That is, a separate gas vent channel (16) communicates with each pair of adjacent openings (22 and 24). A valve stem (26) is disposed about each row. The valve stem can be moved, either rotated or slid, such that pairs of adjacent opening in each row are able to communicate. In operation, as the projectile travels down the barrel, gas from behind the projectile will enter an opening (22), accelerate down the gas vent channel (16), and enter the barrel at the more forward opening (24). Obviously, the openings have to be spaced such that the distance between openings is longer than the projectile plus an additional spacing determined by the relative velocity of the propellant gas in the connecting tube and the projectile in the barrel. The staggering of openings on each row means that the projectile will always be subjected to a restraining force during the venting cycle.

Figure 4:
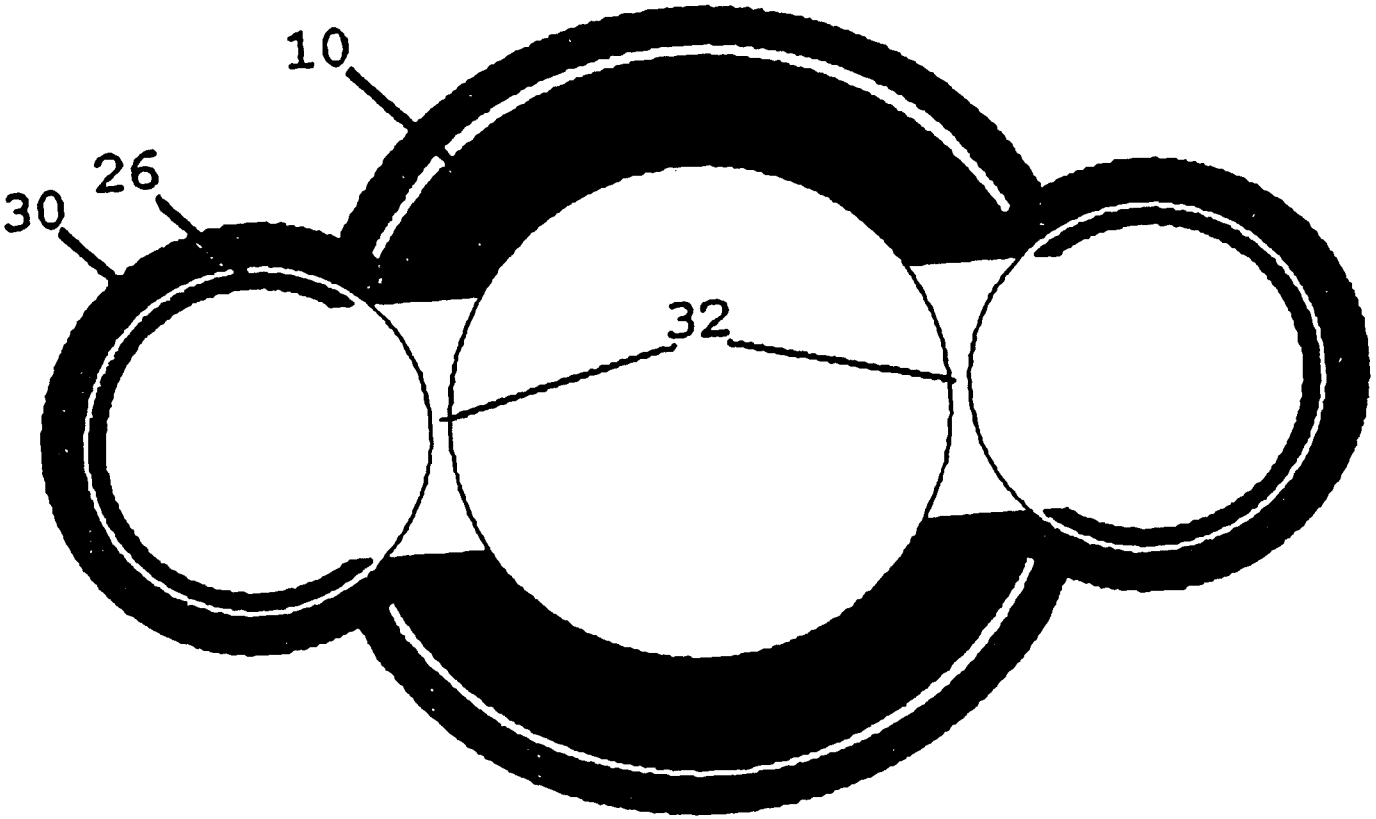
FIG. 4 is a bore sectional view of one embodiment of the venting means using a common gas vent channel.
Figure 5:
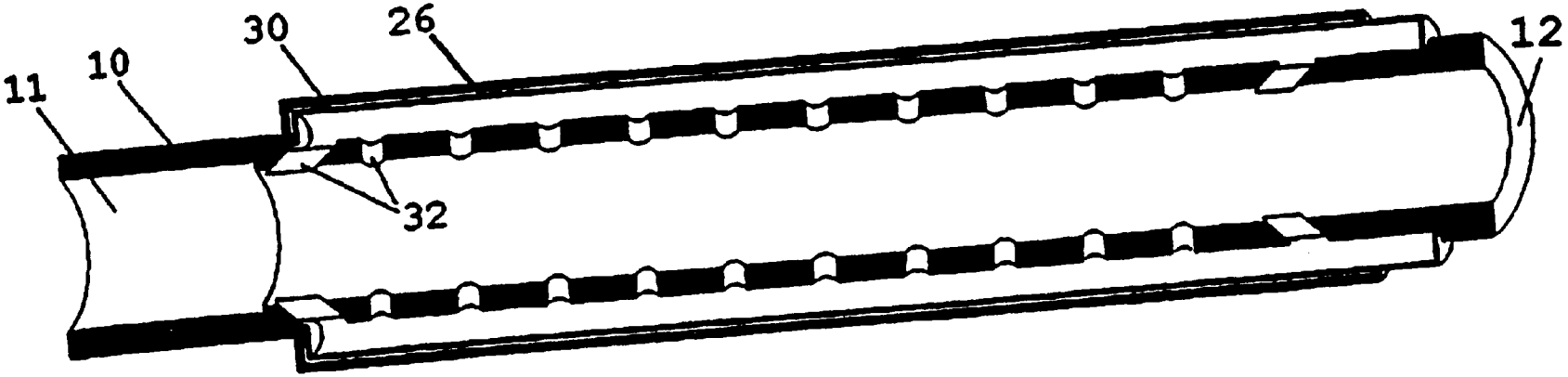
FIG. 5 is a detailed sectional view of one embodiment of the venting means using a common gas vent channel.

A second embodiment of a front venting means is shown in FIGS. 4 and 5. Instead of paired vents, a common gas flow tube (30) communicates with all of the openings (32) in each row. The openings in each row do not have to be staggered. The projectile acts as the throttle over the venting. As the projectile travels toward the muzzle, the number of exit vents, i.e., vents behind the projectile into which propellant gasses can flow into the gas flow tube, increases and the number of reentry vents, i.e., vents in front of the projectile into which propellant gasses can flow out of the gas flow tube and into the barrel, decreases. The openings should range from about $1/16^{th}$ to $1/8^{th}$ the area of the bore of the weapon. They should be distanced about 0.25 to 0.50 inch center to center. There can be only one row or a number of rows. Preferably, the first opening should be about 0.032 inch from the end of the chamber, and the last opening about $1/3^{rd}$ to ½ the barrel length from the muzzle.

A safety feature of the present invention is that the propellant gas forces can never drop to zero before the projectile exits the muzzle, because the venting process stops when the projectile passes the last vent in the mid-section of the barrel. Thus, a bullet will not get stuck in the barrel, and any gas operated auto-loading mechanism will always operate. Also, because gas is exhausted from behind the projectile as it slows down the chamber pressure will not become excessive.

Figure 6:
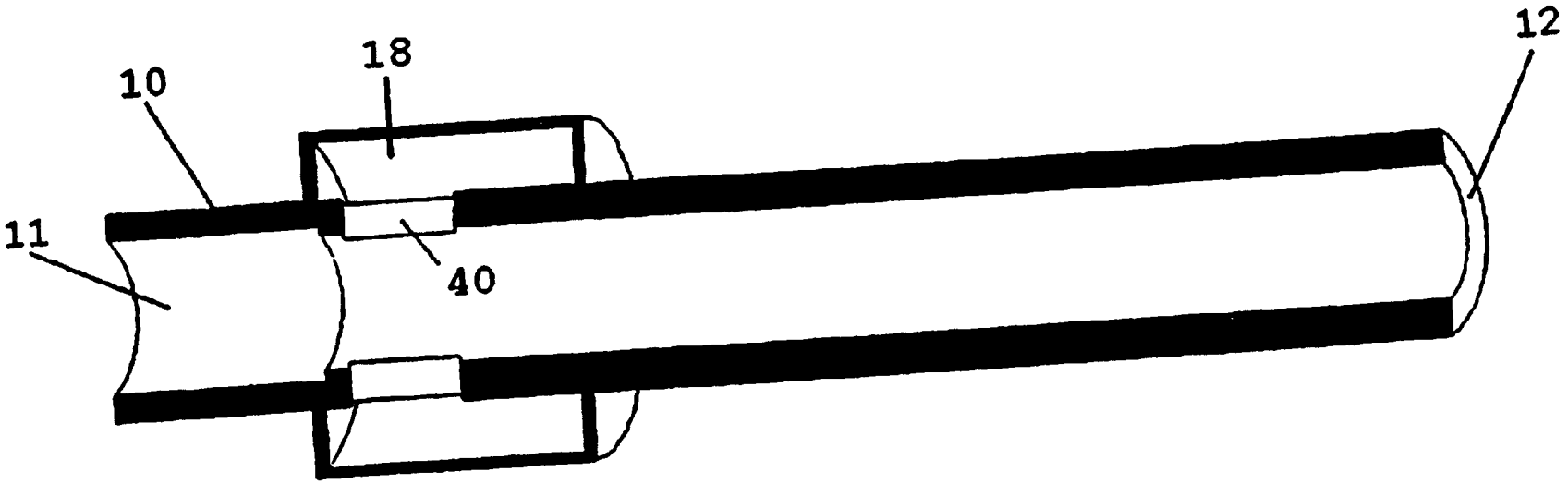
FIG. 6 is a sectional view of a barrel incorporating the present invention using a fixed volume.
Figure 7:
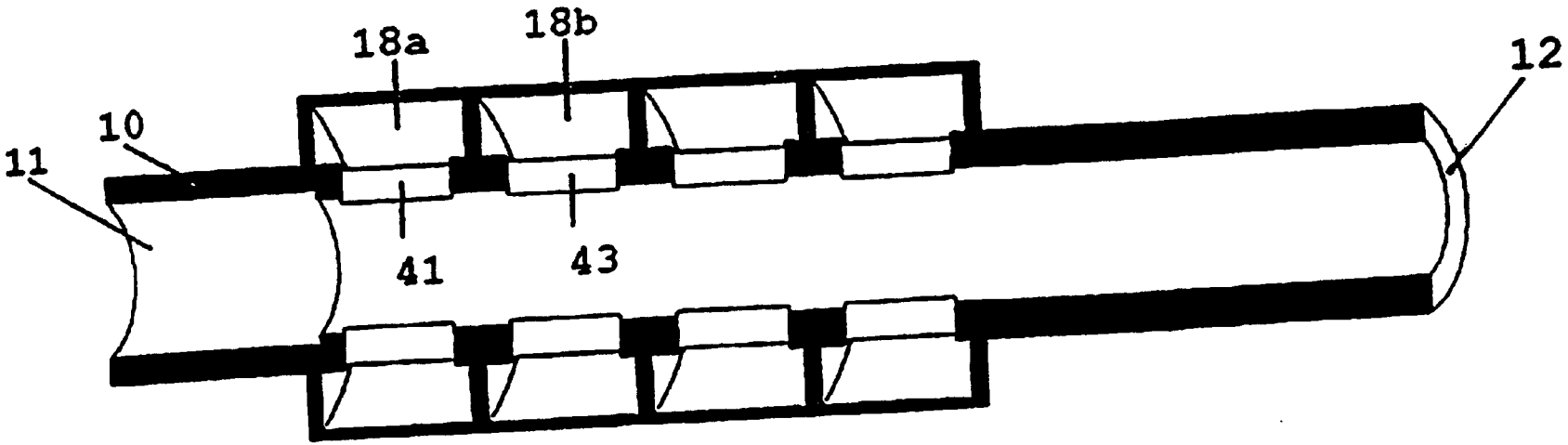
FIG. 7 is a sectional view of a barrel incorporating the present invention using segregated fixed volumes.

Two preferred alternatives using fixed volume venting are also disclosed herein. The first design comprises using a single fixed volume (18), as shown in FIG. 6. A fixed volume vent (40) is located from 0.032 inches to 0.500 inches in front of the end of the chamber to communicate with the fixed volume. Typically, the vent is oval in shape and sized to range from 0.125 inches to 0.250 inches in diameter. The fixed volume can vary, depending upon the degree of pressure reduction desired. The second design comprises using a plurality of segregated fixed volumes **(18*a* and 18*b*), as shown in FIG. 7. A series of fixed volume vents (41 and 43)** are located from 0.032 inches to 2.000 in front of the end of the chamber, a single vent communicating with each fixed volume. Typically, each vent is sized to range from 0.125 inches to 0.250 inches in diameter. The fixed volume can vary in volume, depending upon the degree of pressure reduction desired from each fixed volume. Operating the venting means so as to allow communication with only the first fixed volume would cause a one third reduction, while operating the venting means so as to allow communication with the second fixed volume, as well as first fixed volume would cause a two thirds reduction. A suitable alternative design for controlling venting to the segregated fixed volumes would be to use a single vent which is selectively connected by a manifold to the segregated fixed volumes.

Figure 8:
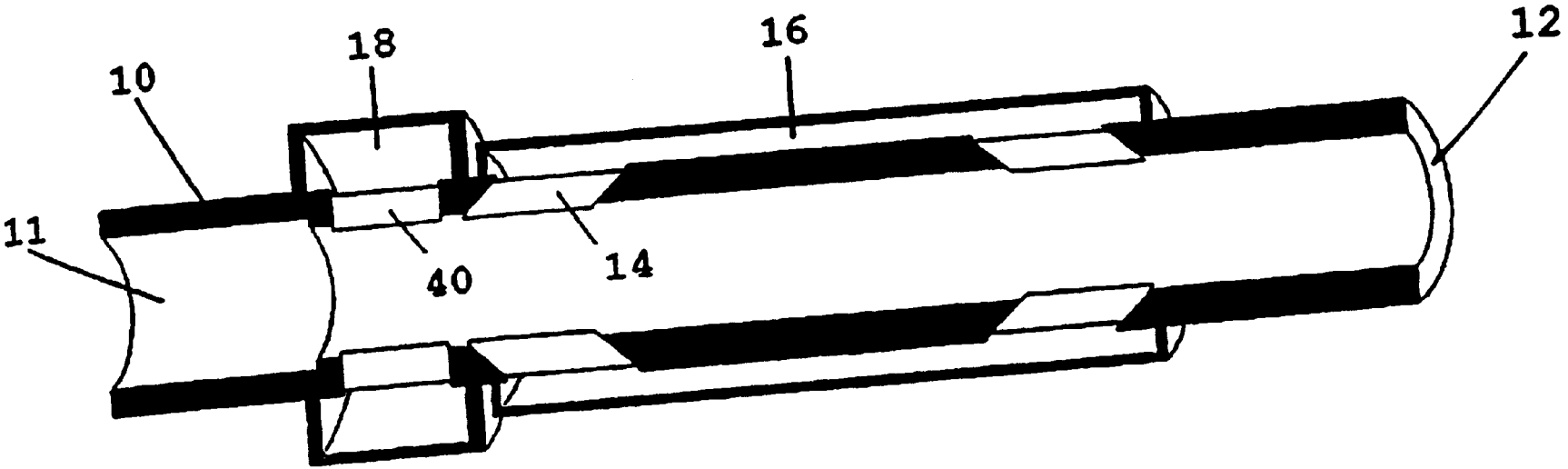
FIG. 8 is a sectional view of a barrel incorporating the present invention using a combination of fixed volumes and paired vents.

The present invention also covers a combination of front venting and fixed volume venting. FIG. 8 illustrates such a combination. One can size the fixed vent to bring about a minimum degree of retardation and use the front vents to selectively reduce from this desired minimum.

Figure 9:
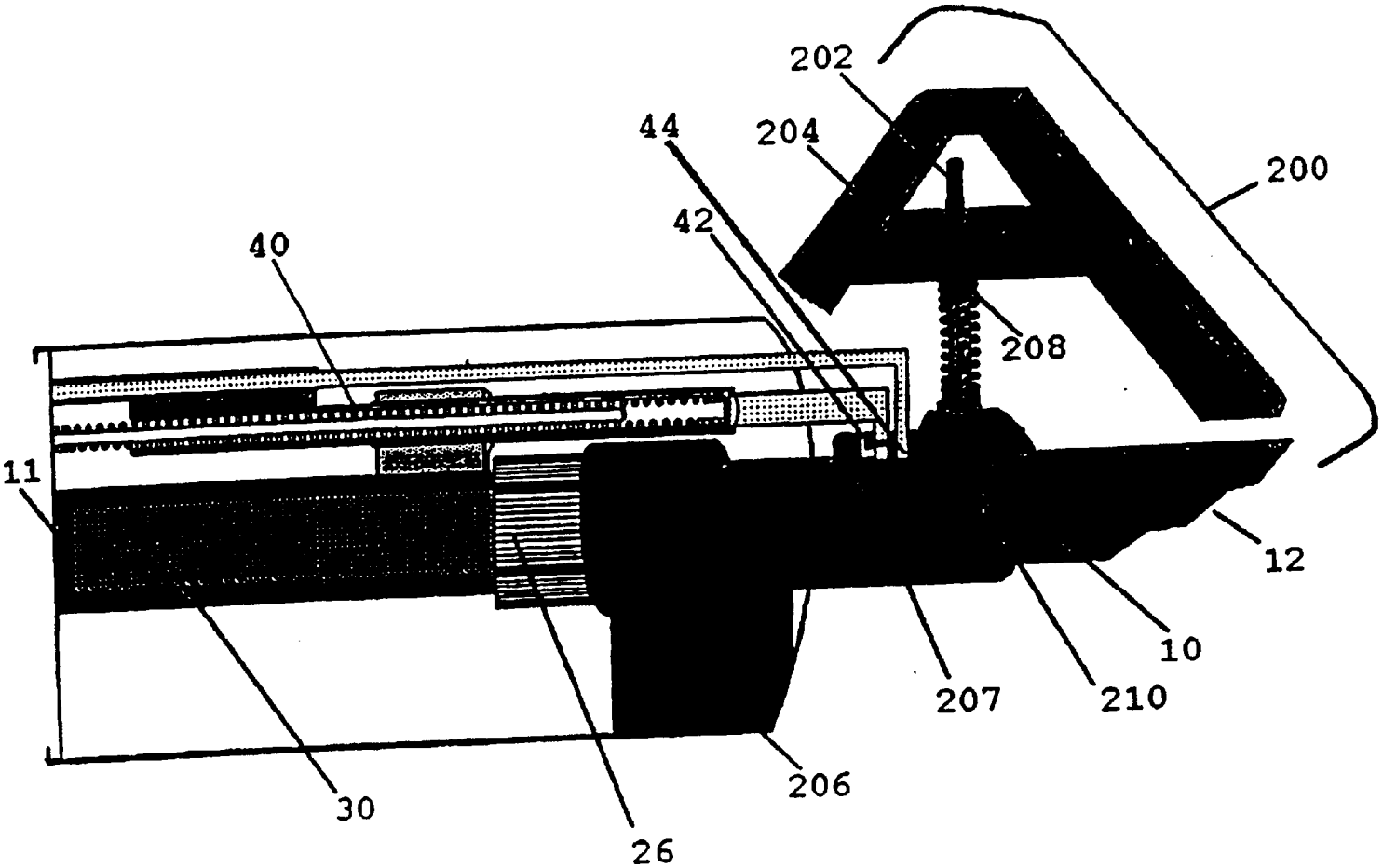
FIG. 9 is a sectional view of a barrel incorporating the present invention using a forward venting with a common gas flow tube.

A preferred barrel design for the M16A2 would incorporate an auxiliary gas piston (46) so as to assist in the gas operated auto-loading operation, FIG. 9. A normal M16A2 rifle uses relatively high pressure gas secured near the muzzle to drive the bolt backwards, extracting the empty brass casing, cocking the hammer, and compressing the recoil buffer spring, which then pushes the bolt forward causing the next round of ammunition to be stripped from the magazine and chambered. Because the present invention lowers the pressures near the muzzle when in the lower velocity mode, the auxiliary gas piston would drive a rod against the bolt carrier to assist the bolt in its rearward travel. The piston would be located on the upper left side of the barrel. When the venting means is set to operate in the lower velocity mode, an assist vent (42) would be opened by the action of a cam (207). The assist vent would allow gas to be vented into the auxiliary gas piston/cylinder thereby augmenting the forces received from the normal gas operation vent (44) located near the muzzle. Alternatively, the auxiliary gas piston can be connected to the common gas tube so that a portion of the gas exhausted to control the muzzle velocity would be used to assist the bolt rearward.

Yet another embodiment of the present invention is a barrel extension device, much like a silencer. The barrel extension device has a proximal end for receiving the projectile and a distal end for discharging the projectile. A venting means is disposed about the extension device. The venting means is configured to direct propellant gasses which are behind the projectile, as the projectile moves from the muzzle end and through the extension device, to the front of the projectile, thereby creating a restraining force on the projectile. The venting means may be either the fixed volume venting means described above, (see FIG. 6), the variable venting means described above, (see FIG. 4), or a combination thereof as described above, (see FIG. 8). The device is attached to an existing barrel by conventional means, such as threads or a locking lug design. The length of the barrel extension device can be varied by varying the volumes of the venting spaces.

Saboted Ammunition

Figure 10:
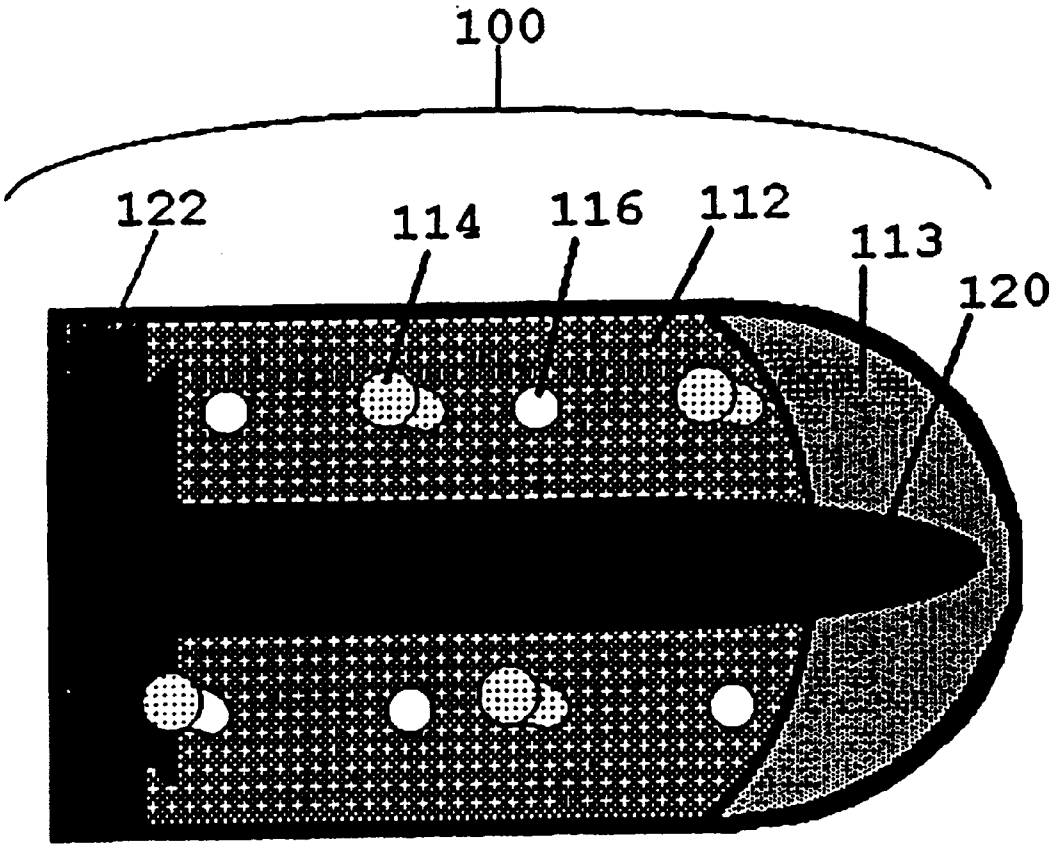
FIG. 10 is a sectional view of a first embodiment of discarding sabot ammunition suitable for use in the barrel of FIG. 1.

In order to combine the ability to be non-lethal at minimum exiting velocities from the controlled venting barrel, saboted ammunition should be used. In use, it can either discard the sabot or retain the sabot for lethal shots, but, in any event, the sabot is retained for non-lethal shots. As shown in FIG. 10, the ammunition includes a projectile (100) that comprises a low cross-sectional density sabot (110), preferably comprising at least two leaves (112) with padding (113), and barbed or oversized pins (114) that fit into detents (116) on opposing surfaces of the sabot leaves, the leaves surrounding a high cross-sectional density long ogive penetrator (120) and a pusher plate (122). The sabot is shed from the penetrator at a predetermined exiting velocity. Suitable materials for the sabot include polyamides, such as Nylon 66 and Torlon, polyurethanes and polyacrylics. The forces reached by a predetermined exiting velocity can separate the pins from the detents or can shear the pins, thus shedding the leaves from the penetrator. The pins can be sized by one of ordinary skill in the art to have a cross sectional thickness which corresponds to the desired strength of the pin material as required by the predetermined exiting velocity.

Typically, the penetrator would have a length that ranges from 50% to 90% of the length of the projectile, and would have a cross sectional area that ranges from 25% to 50% of the cross sectional area of the projectile. For example, for a 0.50 caliber projectile having a penetrator of a size of 5.56 mm or 0.223 cal and a weight of 62 grains, the leaves should separate from the penetrator at a muzzle velocity of at least 2500 fps. Suitable materials for the penetrator include conventional rifle and handgun bullets, tungsten, or hardened steel. Although a 5.56 mm penetrator has been selected as a preferred mode, other size penetrators with differing masses can be selected, as known to those of ordinary skill in the art of ballistics design.

Figure 11:
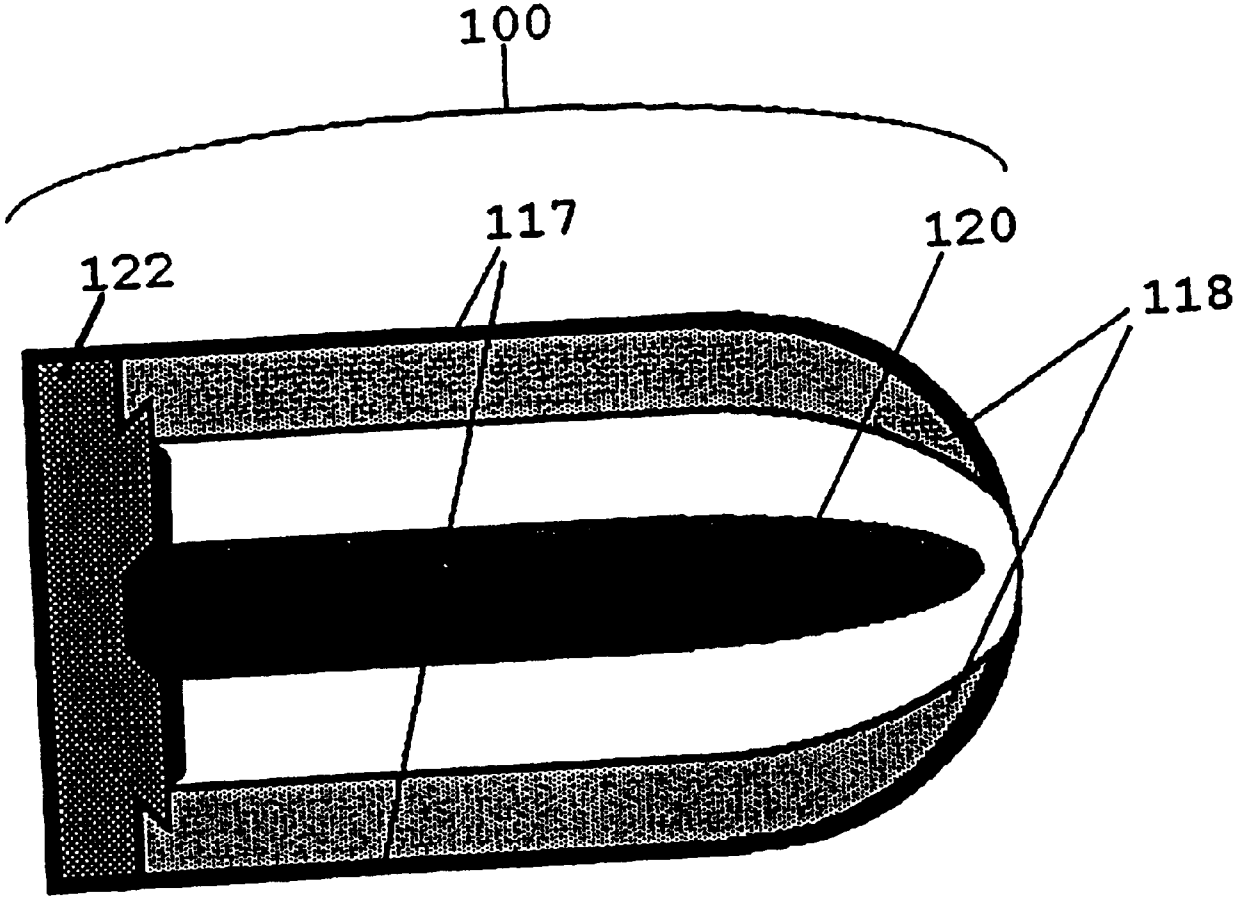
FIG. 11 is a sectional view of a second embodiment of discarding sabot ammunition suitable for use in the barrel of FIG. 1.

Alternatively, as shown in FIG. 11, the sabot can be a unitary design having many scores leaves (117) that create leaves (118) which are capable of breaking off at a predetermined exit velocity. For example, for a 0.50 caliber projectile having a penetrator of 5.56 mm and 62 grains, the leaves should separate from the penetrator at a muzzle velocity of at least 2500 fps. To achieve this separation one would create at least 2 scores along the length of the sabot on the inside of the penetrator cavity, each score ranging from 90% to 110% the length of the penetrator and being about from 0.020 to 0.100 inches deep. Typically, the scoring would be formed in the sabot molding process. In addition, a pusher plate (122) can be placed at the rear of the sabot if the the inertial set back of the penetrator becomes so that the penetrator breaks through the back of the sabot at the desired propellant loading.

Figure 12:
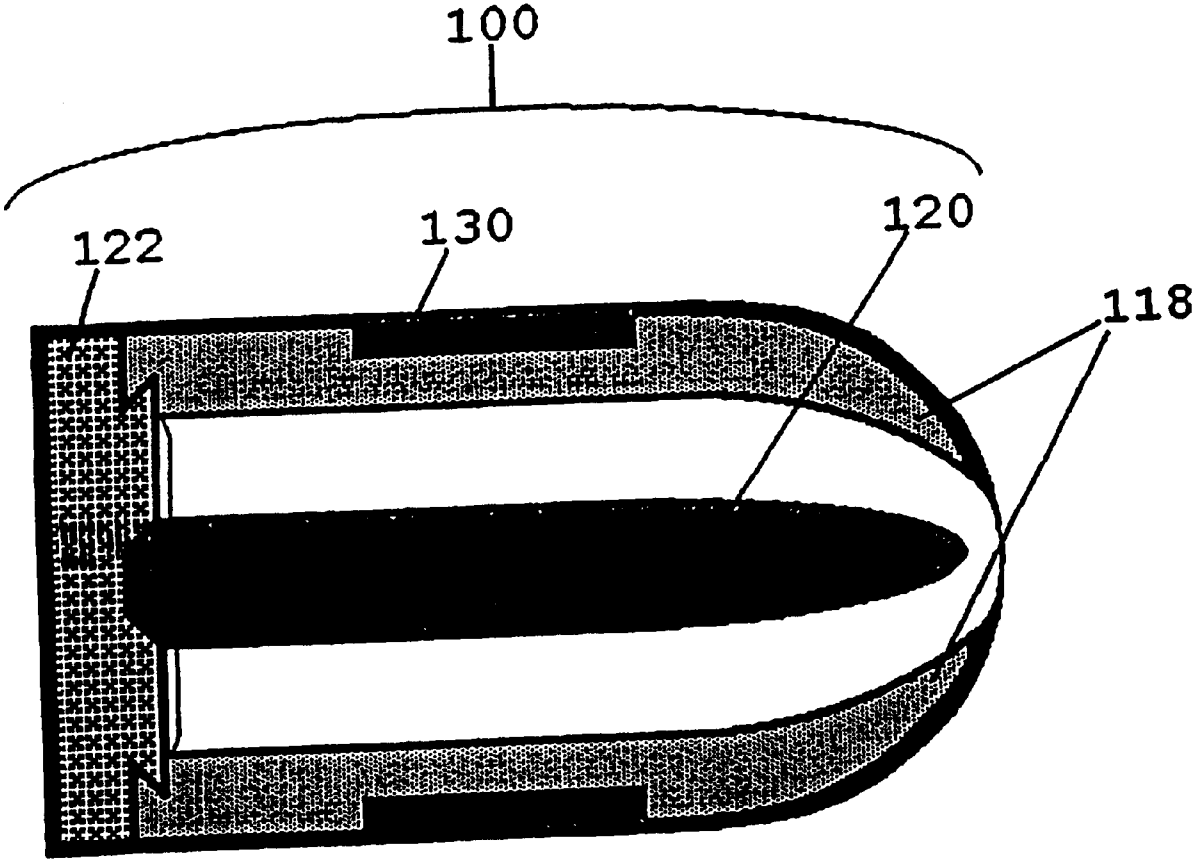
FIG. 12 is a sectional view of a sabot ammunition held together by a band around the outer circumference and is suitable for use in the barrel of FIG. 1.

A second alternative means for shedding the sabot can be used. As shown in FIG. 12, one can use bands (130) about the exterior surface of the sabot to hold together the leaves. The bands can be made from aluminum, copper, steel, or nylon. The bands can be recessed so as not to be exposed to any rifling in the barrel or they can contact the rifling so as to assist in providing spin to the projectile, and thereby serve as an obturator ring. In the latter case, then one must provide for greater strength to the bands. The thickness of the material is such that tensile strength can be exceeded when the saboted ammunition is fired at a predetermined exiting velocity, preferably for a 0.50 caliber projectile having a penetrator of about 0.223 caliber in size and 62 grains in weight, that means about 2500 fps. The bands for such an example would be about 0.25 inches wide and about 0.02 inches thick.

Figure 13:
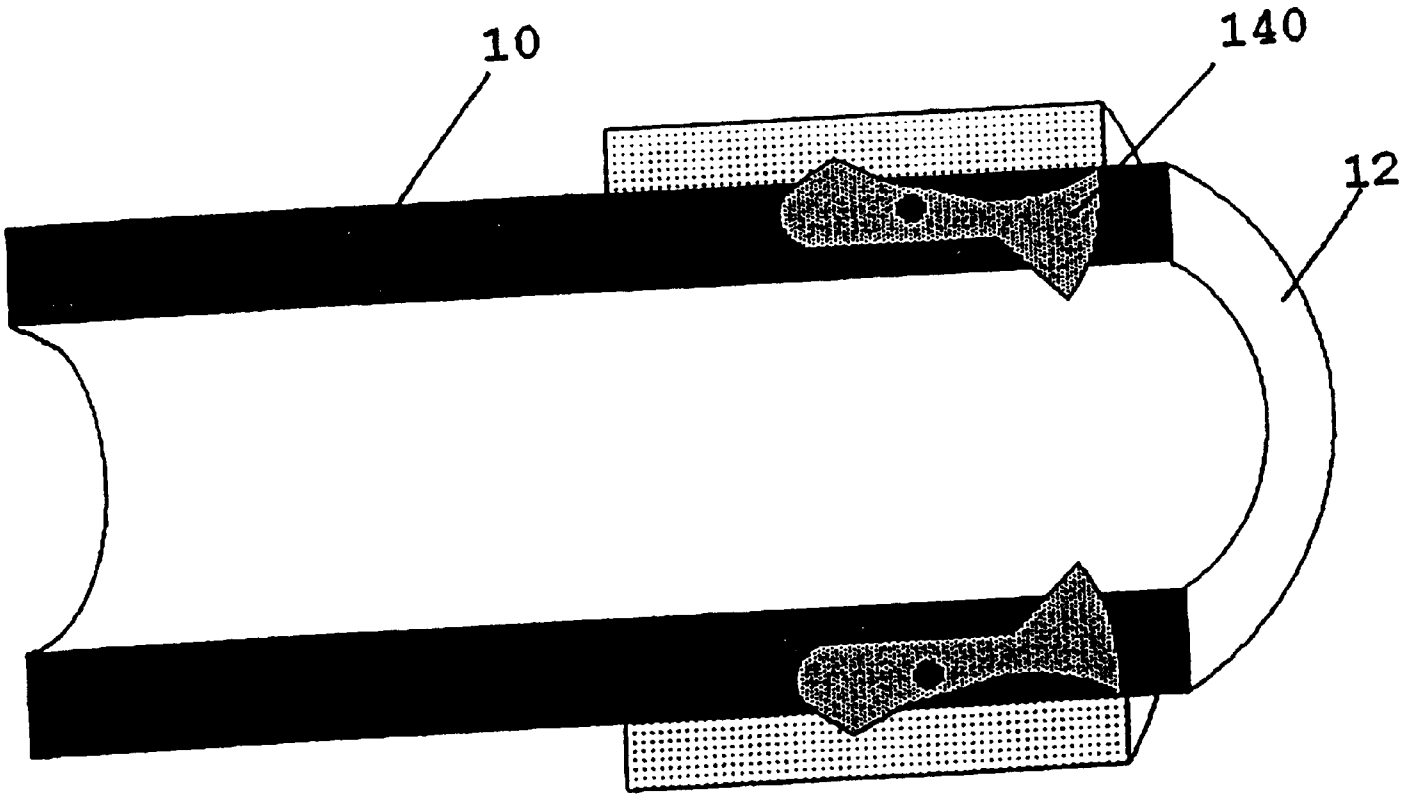
FIG. 13 is a sectional view of a barrel incorporating knives needed for a third embodiment of discarding sabot ammunition.

A third alternative means for shedding the sabot is shown in FIG. 13. Retractable knives (140) can be placed near the muzzle (12). Suitable materials for the knives include high speed tool steel or tungsten carbide. When the more lethal modes of operation are preferred, the knives are extended inwardly, typically from about 0.020 inches to 0.050 inches, toward the barrel opening by mechanical means so as to sever the bands. Polymeric materials having some plasticity would be suitable for the sabot leaves, such as Nylon 66 or Torlon.

Figure 14:
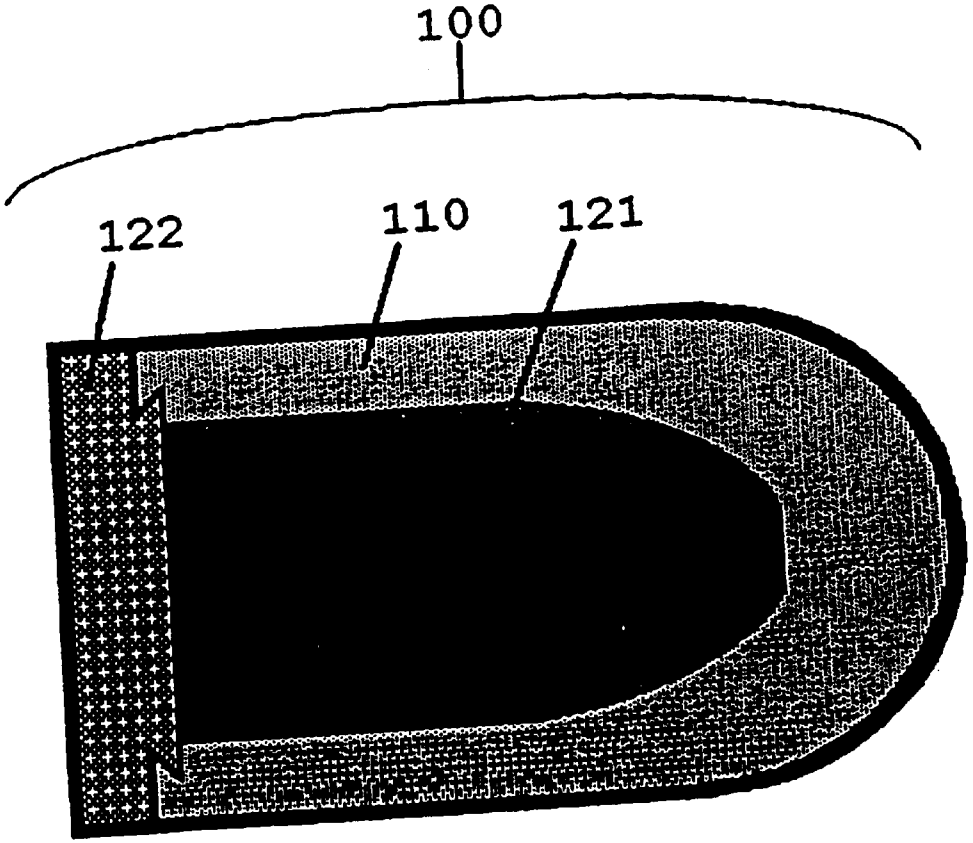
FIG. 14 is a sectional view of a non-discarding sabot ammunition suitable for the present weapon system.

Non discarding sabots may be desired in law enforcement. For example, as shown in FIG. 14, if a 125 grain, 0.357 caliber bullet (121) were cast into a plastic non-discarding sabot so that the total mass was 150 grains and the projectile had a rounded or flat tip so that the ballistics coefficients were 0.0785, the following would happen. At low terminal velocities of less than 328 fps, the projectile would be non-penetrating, producing a blunt non-penetrating impact (BINPI). However, that same projectile, when fired at a lethal velocity of at least 2500 fps, has a muzzle energy of about 2100 fp and, at 200 yards, an impact energy of about 350 fp, (or about halfway between a 0.357 caliber magnum bullet and a 0.45 ACP caliber bullet in energy). The trajectory of the projectile would be as follows: if the rifle is zeroed at 150 yards, the projectile would be 3.5 inches high at 100 yards, 11.5 inches low at 200 yards, and 33 inches low at 250 yards. Thus, a missed chest shot will be approximately 1 foot above the ground and not very lethal to bystanders when the projectile has traveled 250 yards.

When the exiting velocity of a projectile is lowered, the time of flight to the target is increased, resulting in greater projectile drop from the line of the bore as a function of projectile travel. This greatly reduces the range at which the line of sight intersects the trajectory of the projectile. To compensate for the increased arch in the trajectory and to ensure that the line of sight intersects the trajectory at the optimal range for the muzzle velocity selected, either the rear sight must be elevated or the height of the front sight decreased. To ease the operator requirements, a preferred embodiment of the present invention incorporates a self adjusting, auto-compensating front rifle sight (200), which is comprised of a sight pin (202) and a sight guard (204). As shown in FIG. 9, a weapons system having a venting means of the present invention uses a valve stem (26) to rotate or slide so as to open or close barrel vents. The valve stem is connected by means of a linkage (206), either geared, to the hand guard or to a cam mounted on the barrel exterior, below the front rifle sight pin (202). A spring (208) connected to the front rifle sight pin keeps the base of the sight pin pressed against the cam (210). Movement of the hand guard is transmitted to the valve stem and to the sight cam through conventional mechanical linkage known to the art, causing an upwards or downwards movement of the sight pin. As the exiting velocity is decreased by the venting means, the cam will lower the sight pin. In order to maintain the correct sight picture, the operator automatically will raise the muzzle end of the barrel relative to the breach end. This correction for a change in trajectory is transparent to the operator. Automatic adjustment of the front sight is also preferred because it allows manual adjustment of the rear sight which is the standard operating procedure for the rifle when firing the rifle in the lethal mode at targets ranging from 0 to 800 meters. Also, automatic adjustments still allow minor adjustments to the rear sights when firing in the decreased velocity mode.

Conventional electronic range finders can be modified to help an operator automatically achieve a lethal or non-lethal effect. For each non-lethal terminal effect there is an ideal terminal velocity. The selection of a lethal or non-lethal effect is the selection of a terminal velocity. The output from the range finder gives the operator a target range. The operator selects a desired effect, non-lethal or lethal, which can be displayed on the range scope either in script or symbolically. A small target velocity determination microprocessor chip is connected to the range finder such that the range information is transmitted to the chip from the range finder, whereby the chip can calculate by use of a predetermined, programmed ballistic algorithm or looks up from a table the muzzle velocity that will produce the desired terminal velocity at the target range. The chip will then automatically either select, through a solenoid means that actuates the venting means, or display the venting setting needed to produce a muzzle velocity closest to the desired calculated muzzle velocity.

The ordinarily skilled artisan can appreciate that the present invention can incorporate any number of the preferred features described above.

Other embodiments are not presented here which are obvious to those of ordinary skill in the art, now or during the term of any patent issuing from this patent specification, and thus, are within the spirit and scope of the present invention.

We claim:

1. A method for firing a projectile with selectable lethality comprising:

a) loading a cartridge with a saboted projectile into a barrel having a breech end for receiving the cartridge with the saboted projectile and a muzzle end for discharging the saboted projectile, the saboted projectile comprising a penetrator surrounded by a sabot which is configured so as not to release from the penetrator when the projectile exits the muzzle end of the barrel at or below a predetermined muzzle velocity;

b) creating propellant gases behind the projectile so as to accelerate the projectile toward the muzzle end of the barrel; and c) lowering the muzzle velocity of the projectile such that the sabot will not release from the penetrator by opening a means for venting the propellant gases from the barrel at least at a predetermined venting rate.

2. The method of claim 1 wherein the sabot comprises at least two leaves being held about the projectile by at least a band that wraps about the outer exterior surfaces of the leaves, thereby holding the leaves in place.

3. The method of claim 1 wherein the sabot comprises a unitary casting surrounding a penetrator with at least two scores disposed axially lengthwise about the interior surface of the sabot whereby when the predetermined muzzle velocity is exceeded, the increase in both centrifugal force and gas pressure on the front of the sabot caused the sabot material to fracture along the interior scoring and be thrown away from the penetrator.

4. The method of claim 1 wherein the sabot comprises at least two leaves and is held about the projectile by a series of paired pins inserted into detents, each pair of a pin and a detent being on opposing surfaces of adjacent leaves.

5. The method of claim 4 wherein each pin is oversized for the detent and the force needed to pull the pin from the detent or to shear the pin is achieved above the predetermined muzzle velocity.

6. A weapon system having a selectable lethality comprising:

a) a barrel for firing a cartridge having a saboted projectile using propellant gases, having a breech end for receiving the cartridge and a muzzle end for discharging the saboted projectile, the saboted projectile comprising a penetrator surrounded by a sabot which is configured so as not to release from the penetrator when the projectile exits the muzzle end of the barrel at or below a predetermined muzzle velocity;

b) the saboted projectile comprising a penetrator and a sabot, wherein at or below a predetermined muzzle velocity the sabot will not release from the projectile; and c) a means for venting the propellant gases from the barrel at least at a predetermined venting rate which is disposed about the barrel and has at least one opening which can be selectively in communication with the barrel, wherein the venting means lowers the muzzle velocity of the projectile to a level such that the sabot will not release from the penetrator.

7. The weapon system of claim 6 wherein the sabot comprises at least two leaves being held about the projectile by at least a band that wraps about the outer exterior surfaces of the leaves, thereby holding the leaves in place.

8. The weapon system of claim 6 wherein the sabot comprises a unitary casting surrounding a penetrator with at least two scores disposed axially lengthwise about the interior surface of the sabot whereby when the predetermined muzzle velocity is exceeded, the increase in both centrifugal force and gas pressure on the front of the sabot caused the sabot material to fracture along the interior scoring and be thrown away from the penetrator.

9. The weapon system of claim 6 wherein the sabot comprises at least two leaves and is held about the projectile by a series of paired pins inserted into detents, each pair of a pin and a detent being on opposing surfaces of adjacent leaves.

10. The weapon system of claim 9 wherein each pin is oversized for the detent and the force needed to pull the pin from the detent or to shear the pin is achieved above the predetermined muzzle velocity.

11. The weapons system of claim 6 also comprising a means for automatically setting a degree of opening of the venting means, which is connected to the venting means so as to move the venting means from a fully open to a fully closed position and is configured to receive a signal from the range finder scope which directs the degree of opening of the vents once an operator has selected a target and a desired lethality for that target.

12. A method for firing a projectile with a variable velocity comprising:

a) loading a cartridge having a projectile into a barrel having a breech end for receiving the cartridge and a muzzle end for discharging the projectile;

b) opening a means for venting propellant gases from the barrel, the venting means being disposed about the barrel and configured to direct propellant gases which are behind the projectile, as the projectile starts to move from the breech end to the muzzle end, to the front of the projectile, thereby creating a restraining force on the projectile; and c) creating propellant gases behind the projectile which accelerate the projectile toward the muzzle end of the barrel, imparting a muzzle velocity to the projectile, wherein the opening of the venting means lowers the muzzle velocity of the projectile from a maximum muzzle velocity that is achieved if the venting means is not open.

13. The method of claim 12 wherein the cartridge has a saboted projectile, the sabot being configured so as not to release from the projectile if the projectile exits the muzzle end of the barrel at or below a predetermined muzzle velocity, and the venting means being opened such that muzzle velocity of the projectile is lowered to at or below that predetermined muzzle velocity.

14. The method of claim 13 wherein the sabot comprises at least two leaves and is held about the projectile by at least a band that wraps about the outer exterior surfaces of the sabot.

15. The method of claim 13 wherein the sabot comprises at least two leaves and is held about the projectile by a series of paired pins inserted into detents, each pair of a pin and a detent being on opposing surfaces of adjacent leaves.

16. The method of claim 15 wherein each pin is oversized for the detent and the force needed to pull the pin from the detent or to shear the pin is achieved above the predetermined barrel exiting velocity.

17. The method of claim 12 wherein the venting means comprises at least two rows of openings disposed along the length of the barrel, wherein the openings on one side of the barrel are placed about halfway between the openings on an opposing row.

18. The method of claim 17 wherein the openings are paired such that a gas flow tube communicates with each pair of adjacent openings.

19. The method of claim 18 wherein the openings range from about $1/16^{th}$ to $3/16^{th}$ the bore area and are distanced about 1.000 to 1.500 inches center to center, the distance being greater than the length of the projectile traversing the barrel.

20. The method of claim 18 wherein a first opening is about 0.032 inches from the end of a chamber and a last opening is about $1/3^{rd}$ to ½ the barrel length from the muzzle end.

21. The method of claim 17 wherein a valve stem is disposed about each row, the valve stem being able to move such that varying numbers of vents in each row are allowed to communicate with a common gas tube, depending on a desired muzzle velocity.

22. The method of claim 12 wherein the venting means comprises at least one row of openings disposed lengthwise down the barrel, the openings being able to selective communicate or not communicate with a common gas vent channel.

23. The method of claim 22 wherein the venting means also comprises a valve stem that has a plurality of positions that vary the number of vents in communication with the common gas vent channel, thereby varying the muzzle velocity of the projectile.

24. The method of claim 12 wherein the venting means allows communication between a fixed volume and the barrel.

25. The method of claim 24 wherein the fixed volume has a volume of from about 10% to about 100% the volume of the barrel.

26. The method of claim 24 wherein the venting means is disposed about 0.032 to 2.000 inches from the end of a chamber in the breech end of the barrel.

27. The method of claim 24 wherein the venting means also comprises at least two rows of openings disposed along the length of the barrel, wherein the openings on one side of the barrel are placed about halfway between the openings on the opposing row.

28. The method of claim 24 wherein the venting means also comprises at least one row of openings disposed lengthwise down the barrel, the openings being able to selectively communicate or not communicate with a common gas vent channel.

29. The method of claim 12 wherein the venting means allows communication between a plurality of fixed volumes and the barrel.

30. The method of claim 29 wherein the fixed volumes have a total volume of from about 10% to about 100% the volume of the barrel.

31. The method of claim 29 wherein the venting means is disposed about 0.032 to 2.000 inches from the end of a chamber in the breech end of the barrel.

32. The method of claim 29 wherein the venting means allows each fixed volume to be made separately in communication with the barrel.

33. The method of claim 29 wherein the venting means allows the fixed volumes to be made serially in communication with the barrel.

34. The method of claim 29 wherein the venting means also comprises at least two rows of openings disposed along the length of the barrel, wherein the openings on one side of the barrel are placed about halfway between the openings on the opposing row.

35. The method of claim 29 wherein the venting means also comprises at least one row of openings disposed lengthwise down the barrel, the openings being able to selectively communicate or not communicate with a common gas vent channel.

36. A weapon system having a variable velocity comprising:

a) a barrel for firing a cartridge having a projectile using propellant gasses, having a breech end for receiving the cartridge and a muzzle end for discharging the projectile;

b) a means for venting the propellant gases from the barrel, the venting means being disposed about the barrel and configured to direct propellant gasses which are behind the projectile, as the projectile starts to move from the breech end to the muzzle end, to the front of the projectile, thereby creating a restraining force on the projectile; and c) a means for creating propellant gases behind the projectile which accelerate the projectile toward the muzzle end of the barrel, imparting a muzzle velocity to the projectile, wherein the opening of the venting means lowers the muzzle velocity of the projectile from a maximum muzzle velocity that is achieved if the venting means is not open.

37. The method of claim 36 wherein the cartridge has a saboted projectile, the sabot being configured so as not to release from the projectile if the projectile exits the muzzle end of the barrel at or below a predetermined muzzle velocity, and the venting means being opened such that muzzle velocity of the projectile is lowered to at or below that predetermined muzzle velocity.

38. The method of claim 37 wherein the sabot comprises at least two leaves and is held about the projectile by at least a band that wraps about the outer exterior surfaces of the sabot.

39. The method of claim 37 wherein the sabot comprises at least two leaves and is held about the projectile by a series of paired pins inserted into detents, each pair of a pin and a detent being on opposing surfaces of adjacent leaves.

40. The method of claim 37 wherein each pin is oversized for the detent and the force needed to pull the pin from the detent or to shear the pin is achieved above the predetermined barrel exiting velocity.

41. The method of claim 36 wherein the venting means comprises at least two rows of openings disposed along the length of the barrel, wherein the openings on one side of the barrel are placed about halfway between the openings on an opposing row.

42. The method of claim 41 wherein the openings are paired such that a gas flow tube communicates with each pair of adjacent openings.

43. The method of claim 42 wherein the openings range from about $1/6^{th}$ to $3/16^{th}$ the bore area and are distanced about 1.000 to 1.500 inches center to center, the distance being greater than the length of the projectile traversing the barrel.

44. The method of claim 42 wherein a first opening is about 0.032 inches from the end of a chamber and a last opening is about $1/3^{rd}$ to ½ the barrel length from the muzzle end.

45. The method of claim 41 wherein a valve stem is disposed about each row, the valve stem being able to move such that varying numbers of vents in each row are allowed to communicate with a common gas tube, depending on a desired muzzle velocity.

46. The method of claim 36 wherein the venting means comprises at least one row of openings disposed lengthwise down the barrel, the openings being able to selective communicate or not communicate with a common gas vent channel.

47. The method of claim 46 wherein the venting means also comprises a valve stem that has a plurality of positions that vary the number of vents in communication with the common gas vent channel, thereby varying the muzzle velocity of the projectile.

48. The method of claim 36 wherein the venting means allows communication between a fixed volume and the barrel.

49. The method of claim 48 wherein the fixed volume has a volume of from about 10% to about 100% the volume of the barrel.

50. The method of claim 48 wherein the venting means is disposed about 0.032 to 2.000 inches from the end of a chamber in the breech end of the barrel.

51. The method of claim 48 wherein the venting means also comprises at least to rows of openings disposed along the length of the barrel, wherein the openings on one side of the barrel are placed about halfway between the openings on the opposing row.

52. The method of claim 48 wherein the venting means also comprises at least one row of openings disposed lengthwise down the barrel, the openings being able to selectively communicate or not communicate with a common gas vent channel.

53. The method of claim 36 wherein the venting means allows communication between a plurality of fixed volumes and the barrel.

54. The method of claim 53 wherein the fixed volumes have a total volume of from about 10% to about 100% the volume of the barrel.

55. The method of claim 53 wherein the venting means is disposed about 0.032 to 2.000 inches from the end of a chamber in the breech end of the barrel.

56. The method of claim 53 wherein the venting means allows each fixed volume to be made separately in communication with the barrel.

57. The method of claim 53 wherein the venting means allows the fixed volumes to be made serially in communication with the barrel.

58. The method of claim 53 wherein the venting means also comprises at least two rows of openings disposed along the length of the barrel, wherein the openings on one side of the barrel are placed about halfway between the openings on the opposing row.

59. The method of claim 53 wherein the venting means also comprises at least one row of openings disposed lengthwise down the barrel, the openings being able to selectively communicate or not communicate with a common gas vent channel.

* * * * *